US005587021A

United States Patent [19]

Hoersch et al.

[11] Patent Number: 5,587,021

[45] Date of Patent: Dec. 24, 1996

[54] METHOD AND APPARATUS FOR THE CLEANING AND/OR CARE OF FLOORS AND/OR FLOOR COVERINGS OF ALL TYPES

[75] Inventors: Guido Hoersch, Kapfenberger Strasse 28, D-50226 Frechen, Germany; Reinhard Hoersch, Frechen, Germany

[73] Assignee: Guido Hoersch, Frechen, Germany

[21] Appl. No.: 411,606

[22] PCT Filed: Oct. 7, 1993

[86] PCT No.: PCT/EP93/02747

§ 371 Date: Apr. 6, 1995

§ 102(c) Date: Apr. 6, 1995

[87] PCT Pub. No.: WO94/08504

PCT Pub. Date: Apr. 28, 1994

[30] Foreign Application Priority Data

Oct. 10, 1992 [DE] Germany ..... 42 33 888.3

[51] Int. Cl.[6] ..... B08B 3/12; B08B 5/00; A47L 5/10; A47L 5/26

[52] U.S. Cl. ..... 134/1; 134/6; 134/31; 134/33; 134/35; 134/37; 15/320; 15/383

[58] Field of Search ..... 134/1, 6, 23, 33, 134/31, 35, 36, 37; 15/320, 383, 387

[56] References Cited

U.S. PATENT DOCUMENTS

| | | | |
|---|---|---|---|
| 2,764,394 | 9/1956 | Miller | 261/83 |
| 2,923,956 | 2/1960 | Bixler | 15/50.1 |
| 3,755,850 | 9/1973 | Porter | 15/320 |
| 3,795,932 | 3/1974 | Young | 15/98 |
| 4,595,420 | 6/1986 | Williams, III et al. | 15/320 |
| 4,875,249 | 10/1989 | Collier | 15/398 |
| 4,989,293 | 2/1991 | Bashyam | 15/383 |
| 5,016,313 | 5/1991 | Yonehara | 15/320 |
| 5,169,445 | 12/1992 | Yonehara et al. | 15/320 |
| 5,309,593 | 5/1994 | Yonehara | 15/320 |

FOREIGN PATENT DOCUMENTS

| | | |
|---|---|---|
| 0188475 | 8/1988 | European Pat. Off. . |
| 0316576 | 5/1989 | European Pat. Off. . |
| 2615501 | 10/1977 | Germany . |
| 3077529 | 3/1991 | Japan . |
| 789223 | 1/1958 | United Kingdom . |
| 2262219 | 6/1993 | United Kingdom . |
| 90/10415 | 9/1990 | WIPO . |

*Primary Examiner*—Jill Warden
*Assistant Examiner*—Saeed Chaudhry
*Attorney, Agent, or Firm*—Hill, Steadman & Simpson

[57] ABSTRACT

In a method for cleaning and/or care or floors and/or floor coverings of all types such as carpets, plastics, linoleum, parquet, ceramic, ceramic tiles or marble, etc., with a single-disk or multi-disk rotary machine having at least one drive dish, whereby the floor covering is treated with a cleaning and/or care substrate upon application of heat on a case-by-case basis, an especially good and economical operation succeeds in that a stream of hot air and/or heated auxiliary medium is employed as heat carrier and activation medium, and the hot air stream and/or heated auxiliary medium proceeds onto the floor surface through the drive dish. An apparatus suitable for this purpose comprises a drive dish provided with clearances and comprises a hot air generator. The drive dish can be fashioned as a brush at its underside and/or can have an interactive connection to a co-rotating pad.

37 Claims, 6 Drawing Sheets

FIG. 1
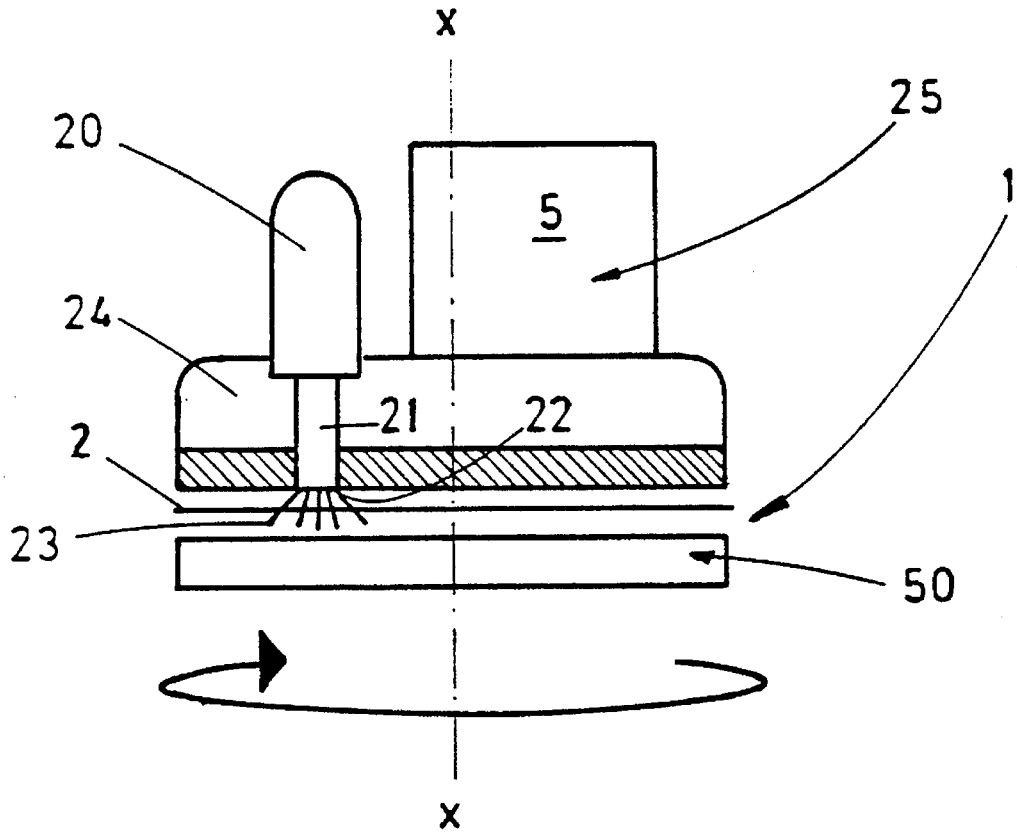
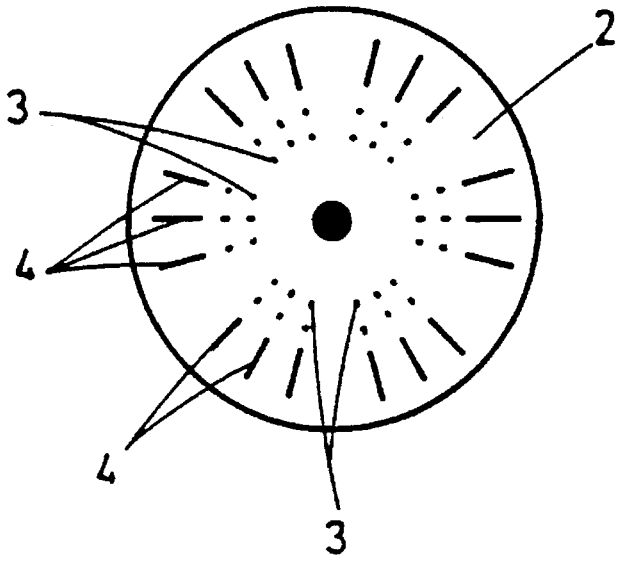
FIG. 2

METHOD AND APPARATUS FOR THE CLEANING AND/OR CARE OF FLOORS AND/OR FLOOR COVERINGS OF ALL TYPES

BACKGROUND OF THE INVENTION

Field of the Invention

The invention is directed to a method and to an apparatus for the cleaning and/or care of floors and/or floor coverings of all types such as carpets, synthetics, linoleum, parquet, ceramic, ceramic tiles or marble, etc., with a single-disk or multi-disk rotary machine.

Great numbers of devices for cleaning floors and/or floor coverings are known. The overwhelming majority of these are constituted, in terms of design and equipment, only for cleaning textile floor coverings and are not suitable for the cleaning or care of other floor coverings such as synthetic, linoleum, parquet or marble.

DE-U-8 304 300.7 discloses a carpet cleaning device that utilizes the electrostatic charging of the dirt particles. Cleaning at elevated temperature is thus not provided; however, EP-B1-0188475 proposes a cleaning at elevated temperature between 40° and 80° [C.] for carpeted floors. A treatment of other floors at elevated temperature is not provided.

Single-disk machines for the cleaning and care of plastic, wood or stone floors are known that are often fashioned with rotating brushes. Such rotary cleaning machines, however, usually do not comprise any means for applying heat to the surface to be processed. When an old layer of polish that has become unattractive due to dirt or abrasion must be removed from the floor before the application of a new polish layer, then this is usually undertaken with a substantial utilization of chemical cleaning agents, particularly with an ecologically suspect, so-called basic cleaner, a highly alkaline or acidic substrate, as well as employment of hot water. The basic cleaner dissolved in hot water was thereby poured onto the floor or distributed with cleaning rags and the dirty layer was removed after a predetermined time with the assistance of the cleaning machine. An uneconomically high employment of manual labor was thereby required in order to carry out this complicated work that is questionable from the point of view of environmental pollution. The action of warm water thereby also decreases quickly given this type of floor cleaning because the water film applied on the floor represents such a slight heat store that an effective heating of the floor layer to be cleaned is not assured.

DE-A-26 15 501 discloses a carpet cleaning machine. This reference discloses a washer vacuum/compressed air/spray and suction system for wet cleaning of permanently laid materials with which cleaning fluid is pressed onto the material to be cleaned with compressed air via a fan nozzle and is in turn immediately extracted by compulsory vacuum. The compressed air can be heated by an electric heater; likewise, the material can be dried by restricted hot air. A substantial disadvantage of this system is caused by the construction that is extremely involved and complicated in design terms; over and above this, effective employment requires substantial experience. Further, great quantities of cleaning agents are required and the drying time is comparatively long, despite heating.

SUMMARY OF THE INVENTION

The present invention is based on the object of specifying a method and an apparatus that are suitable for universal cleaning and/or care of floors and/or care coverings of all types such as carpets, plastics, linoleum, parquet, ceramic, ceramic tiles or marble, etc., and that avoid the aforementioned disadvantages, difficulties and technical limits of known apparatus. In particular, an essentially constant temperature should thus be capable of being set in the region of the working field without requiring a separate heating of the supply of water and/or cleaning agent or care agent. Further such an effective cleaning effect should be capable of being achieved with the method and with the apparatus that a thorough cleaning of floors or floor coverings of all types can be implemented given an extremely economical employment of labor, as well as of cleaning or care agents with less work outlay than hitherto, and while avoiding an employment of chemical, particularly ecologically questionable basic cleaners.

In a method of the species initially cited, this object is inventively achieved in that a hot air stream and/or heated auxiliary medium is employed as heat carrier and activation medium and the hot air stream or, respectively, the heated auxiliary medium proceeds onto the floor surface through the drive plates.

What is surprisingly achieved for the first time with the method is that an essentially constant temperature of the floor or, respectively, floor covering to be handled, is generated and maintained in the region of the work field without a separate heating of the water or, respectively, cleaning or care agent kept on hand being required for this purpose. Such an effective cleaning or care effect is thereby achieved that, for example, even a thorough cleaning of floors of all types given an extremely economical use of labor as well as of cleaning or care agents can be implemented with relatively less work outlay than hitherto, while avoiding an employment of chemical, particularly ecologically questionable basic cleaners. In particular, fatty dirt (approximately 50% of all contaminants contain fat) are dissolved and eliminated substantially faster with the method upon application of controlled heat than with known methods. In view of the great shortage of labor and increasing labor costs, for example in the hospital field, the significant improvement of the cleaning effect which has been demonstrated in trials leads to a noticeable reduction in costs and personnel.

A development of the method provides that the auxiliary medium is heated in steps whereby it is pre-heated in the hot air stream in a first step and is then heated further when passing through the drive plate.

Another development of the method provides that the auxiliary medium is pre-heated upon employment of a heatable collecting dish as a first heating stage.

A further development provides that the auxiliary medium is delivered onto the surface to be treated, passing through the rotational center. An extremely good distribution given simultaneous heating of cleaning or, respectively, care agent as well as floor surface is thereby effected.

Another development provides that the hot air stream emerges against the drive plate and the mat with a comparatively high speed upon formation of a high-energy flow, whereby auxiliary mediums such as water or liquid or, respectively, pasty cleaning or care substrate is delivered through the drive plate onto the floor and is uniformly distributed due to the flow pressure.

A further development of the method provides that the temperature of the surface to be handled is monitored upon employment of a temperature sensor preferably located in the rotational center of the rotor.

A further development provides that the temperature of the surface to be handled is set based on the criterion of a predetermined cleaning or care agenda and/or based on the type of floor covering. The energy expenditure can be set to a comparatively economical degree as a result thereof.

Given optimum cleaning or, respectively, care effect, an extremely economical and effective use of cleaning or care agents as well as of energy and labor are achieved overall.

An apparatus for cleaning and/or care of floors and/or floor coverings of all types comprising a drive unit arranged above a machine housing in a motor housing as well as a rotor driven by said drive unit via a shaft and comprising a drive plate arranged at the underside of the rotor for the implementation of the method of the invention is characterized in that said apparatus comprises a generator for generating a high-energy hot air stream with a hot air conduit and comprises a hot air discharge nozzle directed downward within the machine housing, whereby the hot air generator is equipped with a temperature selector for a plurality of temperature levels;

in that the drive plate comprises holes or, respectively, clearances; and in that the exhaust element of the generator is arranged in an axis that is approximately parallel to the axis of the rotor and has its outlet preferably arranged immediately above the drive dish approximately in the center between rotational center and periphery of the drive dish.

Further advantageous developments are described below. Details, features and advantages derive from the following explanation of the exemplary embodiments schematically shown in the drawings.

BRIEF DESCRIPTION OF THE DRAWINGS

FIG. 1 shows a side view of the apparatus;

FIG. 2 shows a plan view onto the perforated drive dish;

DETAILED DESCRIPTION OF THE PREFERRED EMBODIMENTS

Figures 3, 3A:
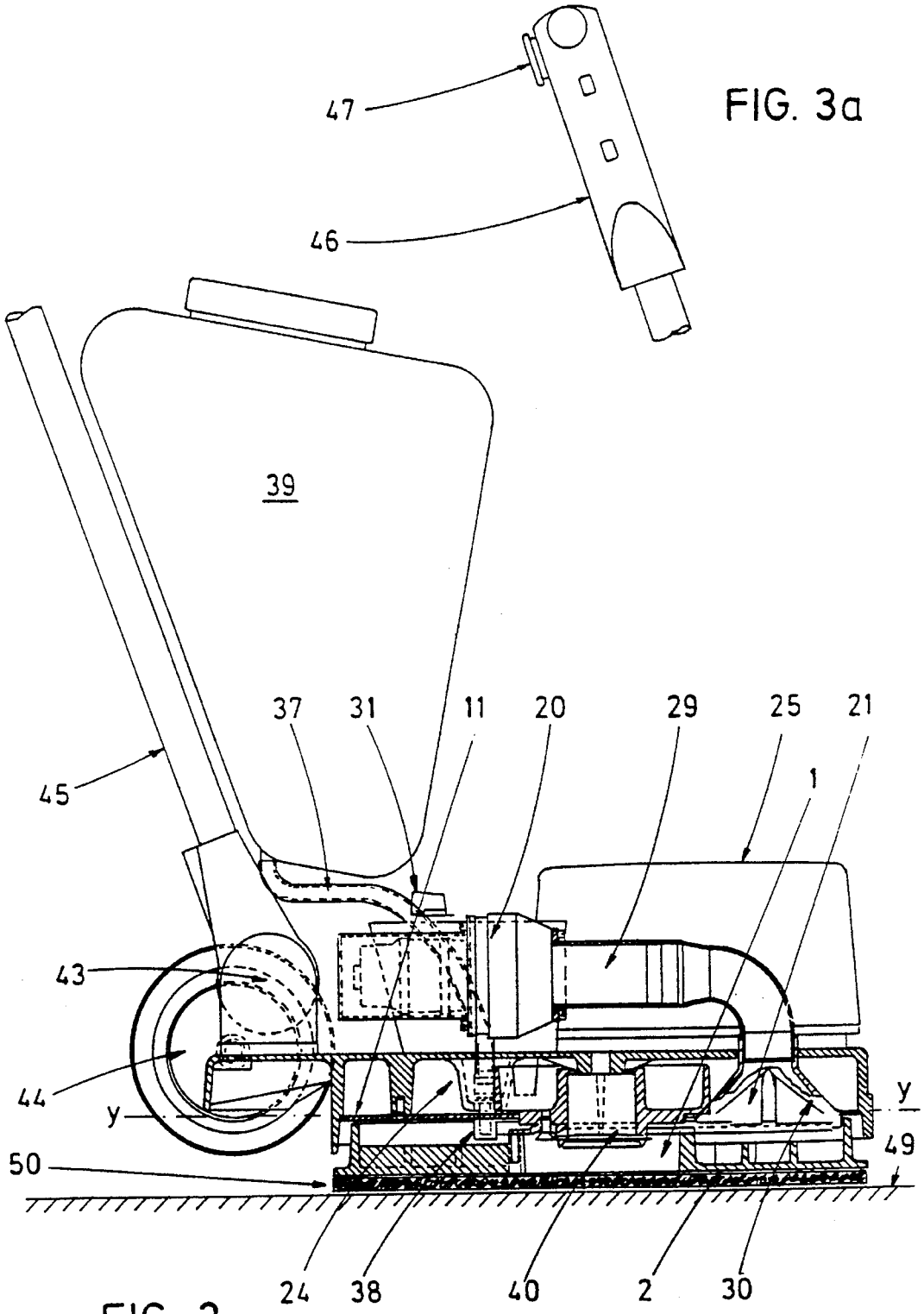
FIG. 3 shows a side view of the apparatus, partially in section.
FIG. 3*a* shows a the upper end of the guide rod in a front view with integrated hand switch.

The apparatus shown in FIG. 1 comprises a rotor 1 having a drive unit 5 in a motor housing 25. The rotor 1 is seated on a shaft (not shown) in the machine housing 24 and has a preferably profiled drive dish 2 at its underside together with a co-rotating mat 50 lying therebelow. As may be seen from FIG. 2, the drive dish 2 is fashioned with holes 3 or, respectively, slot-shaped clearances 4 and potentially has its underside fashioned as a brush.

The mat 50 can be differently implemented in conformity with the type of floor covering 49 to be treated; given employment for carpet cleaning, for example, it comprises a covering with cleaning bristles. The mat 50 can be composed of a porous, textile member, for instance of a fleece with diamond points, and the underside thereof carries a structured covering matched to the respective cleaning procedure. Dependent on the type of cleaning, there are extremely different mats 50, which are also referred to as pads. They can be composed of weaves having a more or less hard textile material; they can be air permeable or impermeable as well for cleaning carpets or materials and, for example, can be composed of polyvinyl fibers. Harder weaves for through cleaning are composed of polyester or, respectively, polyethylene (nylon). For roughing-down work or shampooing, brushes having hard bristles are employed. Other pads, which are composed of disk-shaped fleeces, for example of polyester or nylon, can comprise embedded grinding members dependent on hardness. Such pads are provided with different colors for identification dependent on their lower or greater abrasion. Green-colored pads have moderate abrasion. They are usually employed in cleaner procedures; black pads are utilized for thorough cleaning. Pads can also occasionally comprise clearances.

The apparatus comprises a generator 20, which may include an industrial fan and a device for generating heat such as an infrared radiator or a microwave generator, for generating a hot air stream 23 whose temperature can be set adapted to the nature of the floor or, respectively, floor covering 49 to be treated. A favorable cleaning temperature for textile coverings, for example, lies at 40° Celsius and lies at a maximum of 80° Celsius for non-textile floors and/or coverings.

The hot air generator 20 comprises a blow-out element 21 whose outlet 22 is arranged directly above the drive dish 2. The outlet 22 of the blow-out element 21 is located approximately in the middle between the rotational center and the periphery of the drive dish 2.

As a result of this arrangement, the hot air stream 23 and the clean or care substrate delivered together therewith are advantageously applied onto the floor surface 49 to be cleaned passing through the drive dish or, respectively, the brush 2 and/or the pad 50. The industrial fan 20 thereby generates a hot air stream 23 emerging at comparatively high speed, whereby the action of the hot air, for example through pores in the pad 50 toward the floor surface 49 (FIG. 3), results in an advantageous intensification of the cleaning effect. The advantage is that the quantity of heat transported in the hot air stream 23 is brought to bear on the floor covering surface 49 being cleaned or cared for on a short path through the drive dish 2 and the co-rotating pad 50.

As seen in FIG. 3, the inventive cleaning and care apparatus is equipped with a standard undercarriage, for example having two wheels 44, as well as with a guide rod 45, at the preferably heavy machine housing 24. The apparatus comprises a dosing means 38 for cleaning or care agent whose exit opening is arranged above the drive dish 2. The measure that the dosing means 38 comprises a discharge channel arranged in the rotational axis x—x of the shaft of the rotor 1 can thus be utilized. What is thus achieved is that cleaning or care agent emerging through the rotational center is applied onto the surface 49 to be cleaned and is distributed thereon uniformly and extremely economically by the rotating pad 50. Further, a temperature sensor that extends up against the floor covering 49 to be treated is arranged in the rotational axis x—x. This temperature sensor then cooperates with a known control means for the purpose of optimally setting the temperature of the surface 49 to be cleaned based on the criterion of a predetermined cleaning or care agenda and/or on the type of floor covering.

Figure 7:
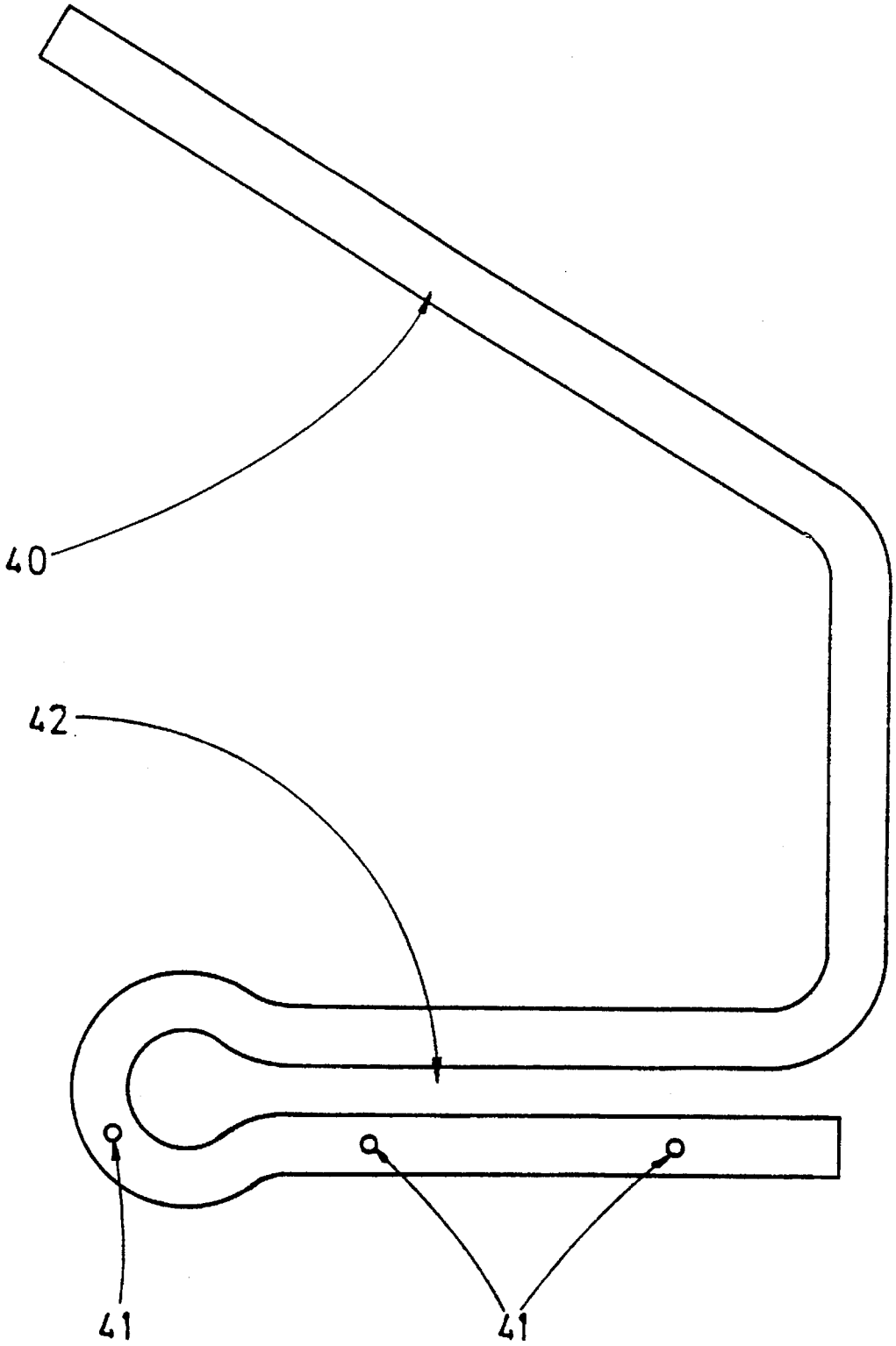
FIG. 7 shows a view of the fluid pipe for auxiliary medium, shown approximately lifesize.

FIG. 3 shows the cleaning machine in a side view and partially in section. This cleaning machine comprises a diecast housing 24 having an undercarriage with two wheels 44 arranged thereat. The guide rod 45 is arranged at the undercarriage and an operating handle 46 having an on/off switch 47 is arranged at the end thereof corresponding to the illustration in FIG. 3*a*. The guide rod 45 is connected to the machine housing 24 in an articulation 43 in a way capable of being hinged up and down. The apparatus comprises a fluid reservoir 39 that optionally accepts water or a cleaning or, respectively, care substrate as and auxiliary medium. The flexible hose 37 is connected thereto, this conducting the auxiliary medium to a dosing means 38. An exit pipe 40 is connected proceeding from the latter, this having its discharge side fashioned with a pipe coil 42 having discharge nozzles 41 shown in FIG. 7. The illustration also shows the motor housing 25 with the internally disposed motor as well as the rotor 1 with drive dish 2 and shows the pad 50 in an interactive connection with the floor or, respectively, floor covering 49. The stationary machine housing 24 shown in section accepts the hot air generator 20 with connected hot air conduit 29 at its upper side, this hot air conduit 29 discharging into the blow-out element 21 with hot air discharge nozzle 30.

Since the setting of the working temperature plays an extremely important part in the apparatus relative to the floors or, respectively, floor coverings 49 to be treated, it is provided that the hot air generator 20 comprises a plurality of temperature levels and a temperature selector 31. For monitoring the working temperature, a temperature sensor (not shown) that extends down against the floor 49 or, respectively, floor covering to be treated is advantageously arranged in the rotational axis x—x of FIG. 1. This temperature sensor is fashioned such, collaborating with a temperature control means 31 of the hot air generator 20, that a working temperature that has been pre-set is maintained under all working conditions.

Figure 4:
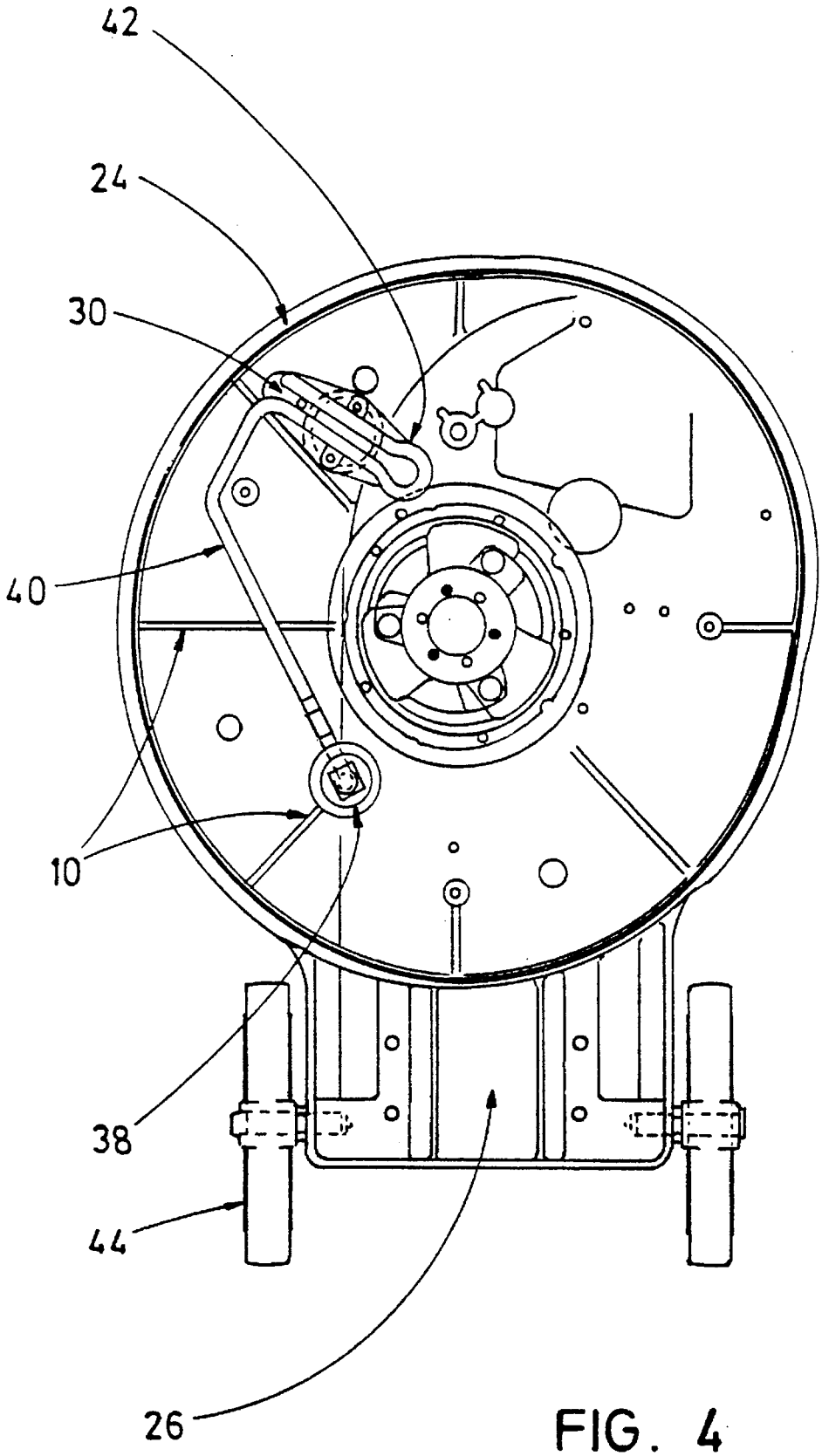
FIG. 4 shows a view of the underside of the apparatus.

FIG. 4 shows the machine housing 24 in a view from below. This is a bell-shaped member downwardly fashioned to form a cavity subdivided by ribs 10, this member being downwardly closed with a preferably thermally insulating cover 11, in a plane y—y of FIG. 3, erected over the ends of the ribs 10. As also proceeds from FIGS. 4 and 7, the discharge pipe 40 equipped with discharge nozzles for auxiliary medium has its end at the discharge side fashioned to form a tube coil forming a heat exchanger and this is arranged in the hot air stream 23 of FIG. 1 below the blow-out element 21 of FIG. 3 composed of the discharge nozzle 30. As a result thereof, the auxiliary medium conducted through the discharge pipe 40 is intensively heated in the hot air stream 23 at a temperature between 250° and 400° Celsius. FIG. 4, moreover, shows the arrangement of the discharge pipe 40 following the dosing means 38 up to its fashioning as pipe coil 42 in the region of the hot air stream 23 under the hot air exit nozzle 30. The wheels of the undercarriage 44 are arranged at a continuation 26 of the machine housing 24.

Figure 5:
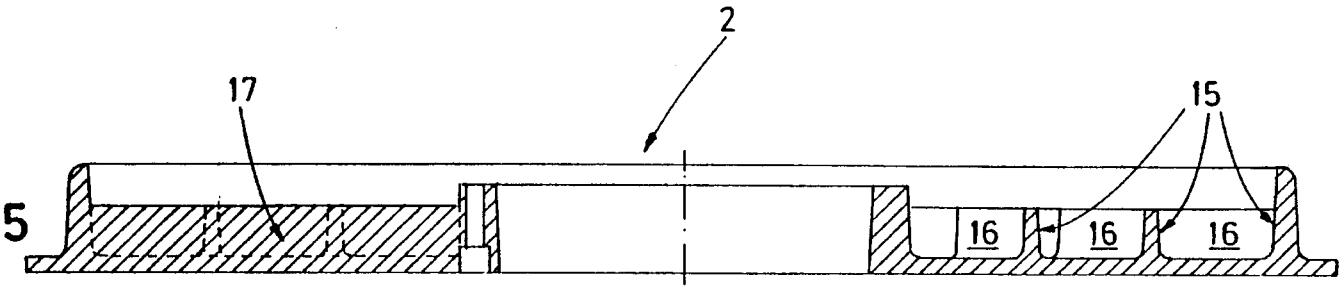
FIG. 5 shows a section through the drive dish along the line of section V—V in FIG. 6.
Figure 6:
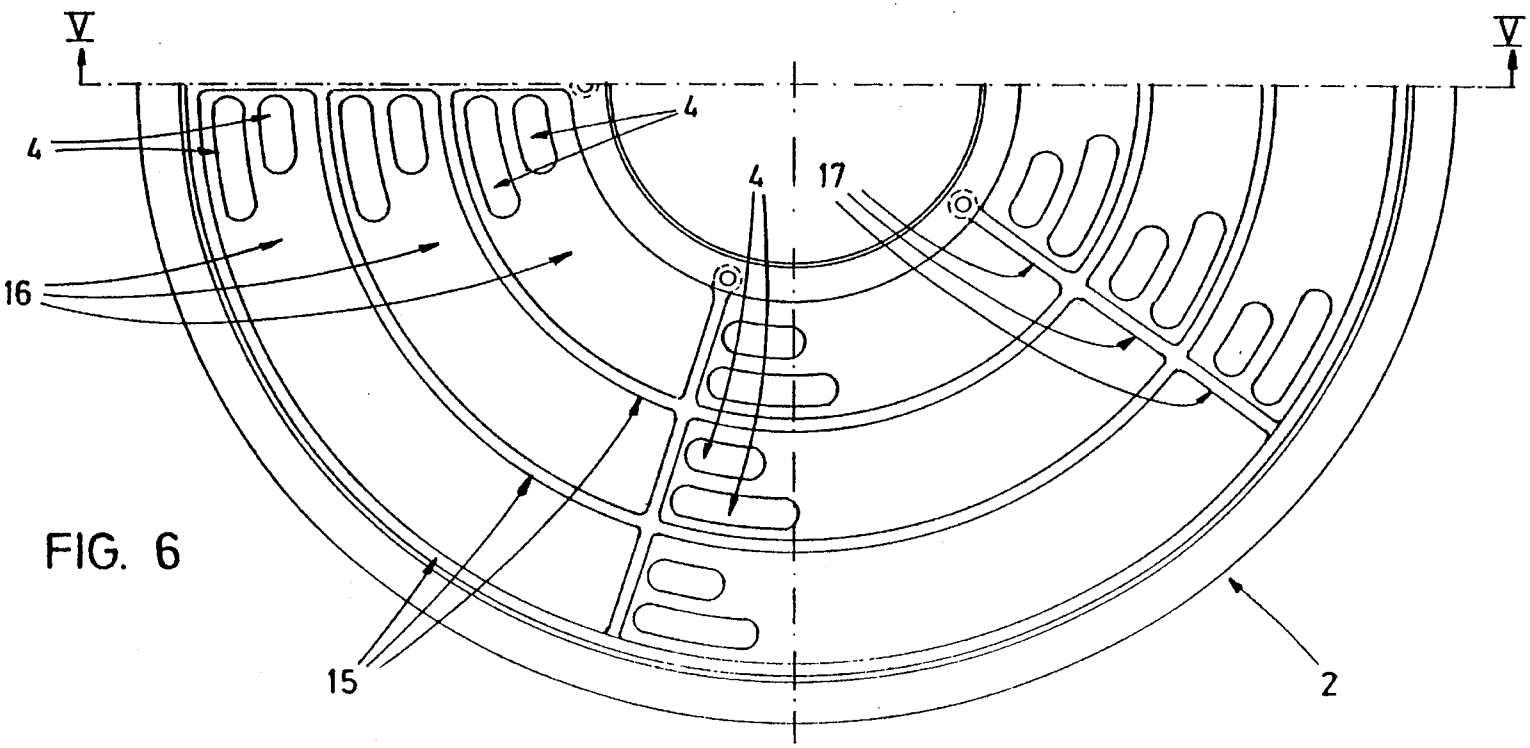
FIG. 6 shows a plan view onto the drive dish according to FIG. 5.

FIGS. 5 and 6 show the drive dish 2 in section as well as in plan view. At its upper side, this comprises concentric ribs 15 arranged in a plurality of radial spacings increasing from the rotational center to the periphery that intensify the heat transmission from the hot air stream 23 in FIG. 1. These ribs are penetrated by radial ribs 17, upon formation of circular sector-shaped, upwardly open cells 16, whereby each cell 16 comprises clearances 4 for delivered auxiliary agent. As viewed in the direction of the rotatory motion of the drive dish 2, these are arranged adjacent to the front side of each radial rib 17.

Figure 8:
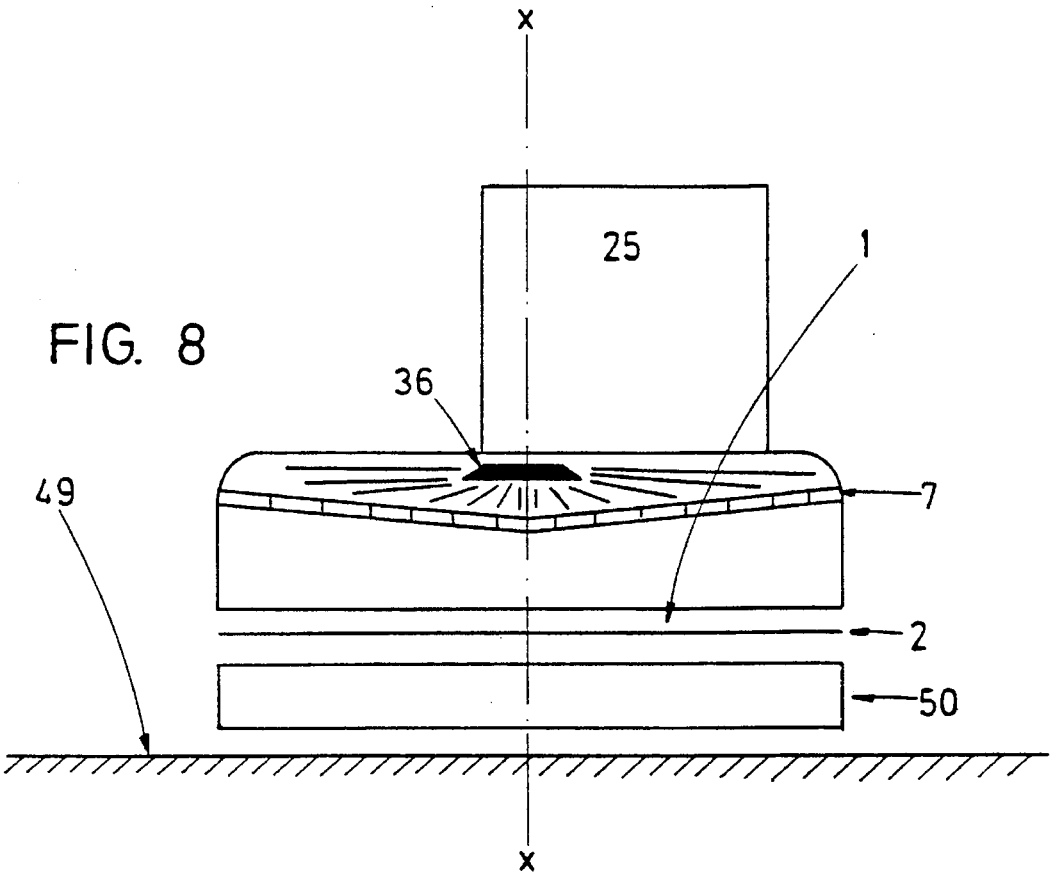
FIG. 8 shows a view of the apparatus with a heated collecting dish.
Figure 9:
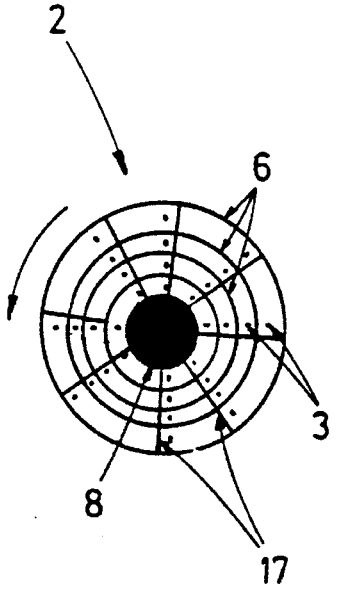
FIG. 9 shows a plan view onto a drive dish with and integrated electric heater.

FIG. 8 shows a somewhat different design of the apparatus. In this embodiment, the auxiliary medium is heated exclusively by heater stages provided with electric heaters 6 (FIG. 9). A heatable collecting dish 7 is arranged above the drive dish 2 as first heating stage. Auxiliary medium is delivered thereunto with the discharge nozzle 36. The collecting dish 7 comprises exit bores distributed approximately uniformly over its surface and through which the auxiliary medium flows uniformly distributed onto the likewise electrically heatable drive dish 2 that forms the second heating stage. The heated auxiliary medium penetrates therethrough into the pad 50 and proceeds in a predetermined temperature condition onto the surface of the floor or, respectively, floor covering 49 to be cleaned.

In this embodiment, electric heater devices 6 are formed in the drive dish 2, as indicated in a primarily schematic fashion in FIG. 9. The drive dish 2 comprises apertures 3 for the passage of water or other auxiliary medium that—as viewed in the direction of the rotatory motion of the drive dish 2—are arranged neighboring the front side of each radial rib 17. A dog flange 8 with integrated power lead (not shown) that is indicated as a black circle is arranged in the region of the rotational center of the drive dish.

The following advantages are achieved with the method and the apparatus of the invention:

- generating an essentially constant temperature at the work field given economical employment of thermal energy;
- the separate heating of cleaning and/or care agents, for example wax or wax emulsion, can be eliminated;
- as a consequence of an enhanced, extremely efficient cleaning effect, the employment of warm water with cleaning agent solution on a case-by-case basis can be eliminated; likewise, the employment of personnel in the delivery, distribution and processing of the care agent is substantially reduced, a noticeable cost-saving being achieved as a result thereof;
- the use of ecologically questionable basic cleaners having a highly alkaline or acidic concentration can be substantially reduced if not entirely eliminated since "gentle" cleaners are employed as a result of the elevated working temperature in the working field.

As a consequence of the high performance capability given reduced employment of personnel, an extremely broad field of employment derives as the area of the employment of the method and of the cleaning machine, such as, for example:

- department store areas, particularly meat departments, cheese department, etc., that were hitherto cleaned in a conventional way with scrubbers and pick-ups because these were not accessible to automatic units for reasons of space. The shorter, easier and cost-saving operation is advantageous.
- napped floors were hitherto cleaned with single-disk machines and scrubber brushes. Installed articles were thereby contaminated by splashes of water and required further work for after-cleaning. The method and the apparatus of the invention alleviates this situation. Included among further areas of employment are:
- warm shampooing given textile coverings that do not shrink at elevated temperature. Enhanced dissolving of dirt and a reduced chemical part due to thermal treatment are advantageous.

Cleaner methods: heat promotes the dissolving of dirt and the absorption of dirt.

Thorough maintenance cleaning (intermediate cleaning) of large areas is possible at low cost.

Streaks, films and striae after cleaning polished surfaces are reduced since usually too much or too little cleaning agent was employed in the hitherto, cold, conventional procedure.

Non-neutral cleaning agents can no longer damage the floor covering to be cleaned as a consequence of an excessively high dosing since weaker cleaning agents and/or lower concentrations of the cleaning agent are required as a result of the heat factor.

Optimum polishing qualities are possible outside the high-speed range, as are repairs of damaged polished surfaces due to the action of heat.

Overall, the possibilities of employment are substantially expanded and the cleaning method is rationalized with the invention, as a result whereof surprisingly beneficial cost-savings can be achieved and service concerns burdened by increasing costs for personnel can work more economically and efficiently.

The inventive measures are not limited to the exemplary embodiments shown in the FIGS. of the drawing. A possible modification of the apparatus of the invention can be comprised therein that a different type of temperature generation or guidance of the hot air stream ensues. Further, the drive dish or dishes can be fashioned in any desirable way and can comprise various hole or, respectively, aperture patterns for the passage of air and/or cleaning or, respectively, care agent and can also comprise various brush profiles. The respective design embodiment is at the discretion of a person skilled in the art in adaptation to specific employments of the apparatus.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim as my invention:

1. A method for the treatment of a surface, the surface being bare floor, a tiled floor or a floor with a covering including a carpet, upon an application of an auxiliary medium and an application of heat with a machine, wherein the machine has means for heating an air stream, at least one rotary disk and at least one drive dish with an opening through said dish for the passage of said hot air stream and at least one opening for said auxiliary medium, comprising the steps:

heating said air stream to provide a heated air stream;

pre-heating said auxiliary medium in said heated air stream to provide a pre-heated auxiliary medium;

directing said heated air stream through said drive dish;

directing said pre-heated auxiliary medium through said drive dish;

heating said pre-heated auxiliary medium with said heated air stream as said pre-heated auxiliary medium and said heated air stream pass through said drive dish.

2. A method according to claim 1, wherein said preheating step further comprises pre-heating said auxiliary medium in a heatable collecting dish.

3. A method according to claim 1, wherein said drive dish is mounted on a rotatable rotor, the method further comprising delivering said auxiliary medium through a rotational center of said rotor.

4. A method according to claim 1, wherein said air stream is heated and is directed against said drive dish at a comparatively high speed upon formation of a high-energy flow, whereby said auxiliary medium is delivered through the drive dish and uniformly distributed by a flow pressure of said heated air stream.

5. A method according to claim 1, further comprising monitoring a temperature of the surface to be treated by use of a temperature sensor.

6. A method according to claim 5, further comprising setting a temperature of the hot air stream based on a criterion of a predetermined cleaning or care agenda.

7. A method according to claim 5, further comprising setting a temperature of the hot air stream based on the type of floor covering.

8. A method according to claim 5, further comprising setting a temperature of the surface being processed based on particular qualities of the surface being processed.

9. A method according to claim 5, further comprising setting a temperature of the surface being processed based on a criterion of a predetermined cleaning or care agenda.

10. A method according to claim 1, further comprising heating of said surface with wireless energy transmission by microwave or infrared radiation.

11. An apparatus for treatment of a surface, the surface being a bare floor, a tiled floor or a floor with a covering including a carpet, upon an application of an auxiliary medium and an application of heat, comprising:

a machine housing;

a drive unit arranged above said machine housing in a motor housing;

a rotor driven by said drive unit via a shaft;

a drive dish arranged at an underside of said rotor;

a generator for generating a high-energy hot air stream with a hot air conduit and a downwardly directed hot air discharge nozzle inside the machine housing;

a temperature selector operatively connected to said generator for selecting one of a plurality of temperature levels;

said air discharge nozzle being arranged along an axis approximately parallel to a rotational axis of said rotor and having its outlet arranged immediately above said drive dish between a rotational center and a periphery of said drive dish;

a dosing means for said auxiliary medium whose discharge aperture is arranged above the drive dish, a container for said auxiliary medium preceding the dosing means, as well as having a discharge pipe and discharge nozzles following said dosing means, whereby said discharge pipe is fashioned to form a pipe coil at its discharge-side end which forms a heat exchanger and said discharge-side end is arranged in said hot air stream under said air discharge nozzle.

12. An apparatus according to claim 11, wherein said machine housing is a hollow member having an internal cavity subdivided by ribs, said housing being closed at a bottom surface with a thermally insulating cover which encloses said ribs.

13. An apparatus according to claim 11, wherein said upper side of said drive dish comprises concentric ribs arranged in a plurality of radial spacings increasing from the rotational center to the periphery that intensify the heat transmission from the hot air stream and that are penetrated by radial ribs upon formation of circular sector-shaped, upwardly open cells, whereby each cell comprises apertures for delivered auxiliary medium and these apertures, as viewed in a direction of the rotational motion of said drive dish, are arranged adjacent to a front side of each radial rib.

14. An apparatus according to claim 11, wherein electric heater devices are formed in said drive dish; and wherein a heatable collecting dish for said auxiliary medium is arranged above said drive dish, said collecting dish comprising discharge bores distributed over its surface.

15. An apparatus according to claim 11, wherein said rotor comprises a discharge channel arranged in the rotational axis in which a temperature sensor extending down against the floor or floor covering to be processed is arranged.

16. An apparatus according to claim 11, wherein said drive dish is fashioned as a brush at its underside.

17. An apparatus according to claim 11, wherein said generator comprises an infrared radiator arranged inside said machine housing.

18. An apparatus according to claim 11, wherein said generator comprises a microwave generator arranged inside said machine housing.

19. A method of cleaning a surface, including a floor or a carpet, the method comprising:

rotating a drive dish above the surface, the drive dish including at least one aperture for permitting communication between an upper side of the drive dish and the surface below the drive dish;

heating an air stream to provide a heated air stream;

directing the heated air stream toward the upper surface of the rotating drive dish;

directing an auxiliary medium stream toward the upper surface of the rotating drive dish;

heating the auxiliary medium stream with the heated air stream as both the auxiliary medium stream and the heated air stream engage the drive dish and pass through the drive dish to the surface below.

20. The method of claim 19, further comprising pre-heating an auxiliary medium stream in the heated air stream to provide a pre-heated auxiliary medium steam prior to the directing of the auxiliary medium stream toward the upper surface of the rotating drive dish.

21. The method of claim 20, wherein said pre-heating step further comprises pre-heating the auxiliary medium stream in a heatable collecting dish.

22. The method of claim 19, wherein the auxiliary medium stream is directed through a rotational center of the drive dish.

23. The method of claim 19, further comprising monitoring a temperature of the surface to be treated by use of a temperature sensor.

24. The method of claim 23, further comprising setting a temperature of the hot air stream based on a predetermined cleaning or care agenda.

25. The method of claim 24, further comprising setting a temperature of the surface being processed based on a predetermined cleaning or care agenda.

26. The method of claim 19, further comprising heating of the surface with wireless energy transmission by microwave or infrared radiation.

27. An apparatus for cleaning a surface including a floor or carpet, the apparatus comprising:

a rotatable drive dish;

a generator for generating a hot air stream, the generator being in communication with a downwardly directed hot air discharge outlet, the hot air discharge outlet being arranged above the drive dish;

a reservoir of an auxiliary medium, the reservoir being in communication with a dosing means for discharging the auxiliary medium to the drive dish;

the drive dish including at least one aperture through which the hot air and auxiliary medium pass through, the drive dish mixing the hot air and the auxiliary medium together as the drive dish rotates so that the auxiliary medium is heated by hot air as the auxiliary medium and hot air pass through the drive dish.

28. The apparatus of claim 27, wherein the dosing means is in communication with a discharge conduit, the discharge conduit including a discharge aperture arranged above the drive dish, a portion of the discharge conduit being disposed in front of the hot air discharge outlet thereby allowing hot air being discharged by the hot air discharge outlet to pre-heat auxiliary medium being carried by the discharge conduit.

29. The apparatus of claim 28, wherein the portion of the discharge conduit disposed in front of the hot air discharge outlet forms a coil for enhanced heat transfer from the hot air to the auxiliary medium.

30. The apparatus of claim 27, further comprising a temperature selector operatively connected to the generator for selecting one of a plurality of temperature levels.

31. The apparatus of claim 27, wherein the drive dish includes an upper side, the upper side of the drive dish includes a plurality of spaced concentric ribs for increasing heat transmission between the hot air stream and the auxiliary medium as the hot air and auxiliary medium are discharged onto the drive dish.

32. The apparatus of claim 27, wherein the drive dish includes electric heating devices.

33. The apparatus of claim 27, further comprising a heatable collecting dish for pre-heating the auxiliary medium, the collecting dish being disposed above the drive dish, the collecting dish including discharge bores distributed over its surface.

34. The apparatus of claim 27, further comprising a rotor, the drive dish being disposed at an underside of the rotor, the rotor comprising a discharge channel arranged in a common rotational axis of the drive dish and rotor, the discharge channel accommodating a temperature sensor, the temperature sensor extending downward to engage the surface.

35. The apparatus of claim 27, wherein said drive dish includes a brush attached to an underside of the drive dish.

36. The apparatus of claim 27, wherein the generator comprises an infrared radiator arranged inside said machine housing.

37. The apparatus of claim 27, wherein the generator comprises a microwave generator arranged inside said machine housing.

* * * * *